US011345442B2

(12) United States Patent
Longman et al.

(10) Patent No.: US 11,345,442 B2
(45) Date of Patent: May 31, 2022

(54) WATER CRAFT SUSPENSION ARRANGEMENT

(71) Applicant: Nauti-Craft Pty Ltd, Dunsborough (AU)

(72) Inventors: Michael James Longman, Dunsborough (AU); Richard Monk, Yalyalup (AU)

(73) Assignee: Nanti-Craft Pty Ltd, Dunsborough (AU)

( * ) Notice: Subject to any disclaimer, the term of this patent is extended or adjusted under 35 U.S.C. 154(b) by 0 days.

(21) Appl. No.: 16/770,216

(22) PCT Filed: Dec. 7, 2018

(86) PCT No.: PCT/AU2018/051315
§ 371 (c)(1),
(2) Date: Jun. 5, 2020

(87) PCT Pub. No.: WO2019/109151
PCT Pub. Date: Jun. 13, 2019

(65) Prior Publication Data

US 2021/0188399 A1 Jun. 24, 2021

(30) Foreign Application Priority Data

Dec. 8, 2017 (AU) ..... 2017904950

(51) Int. Cl.
*B63B 3/08* (2006.01)
*B63B 1/04* (2006.01)

(52) U.S. Cl.
CPC . *B63B 3/08* (2013.01); *B63B 1/04* (2013.01)

(58) Field of Classification Search
CPC ..... B63B 3/08; B63B 1/04; B63B 2001/045; B63B 2001/145; B63B 39/00; B63B 1/14;
(Continued)

(56) References Cited

U.S. PATENT DOCUMENTS 2,347,959 A 5/1944 Moore et al.
3,326,166 A 6/1967 Yost
(Continued)

FOREIGN PATENT DOCUMENTS

WO 2013181699 12/2013
WO 2015172188 11/2015

OTHER PUBLICATIONS

International Search Report for Application No. PCT/AU2018/051315 dated Feb. 1, 2019 (5 pages).
(Continued)

*Primary Examiner* — Anthony D Wiest
(74) *Attorney, Agent, or Firm* — Michael Best & Friedrich LLP

(57) ABSTRACT

A hull locating arrangement for a vessel is disclosed that has a body at least partially suspended above at least a first hull by at least one support. The hull locating arrangement includes for the first hull a forward locating linkage and a rearward locating linkage, each of the forward locating linkage and the rearward locating linkage being connected between the first hull and the body to together constrain said hull in the lateral, longitudinal, roll and yaw directions relative to the body. The forward locating linkage includes a forward radius arm and a drop link, the drop link being pivotally connected to the radius arm. The rearward locating linkage includes a rearward radius arm connected between the body and the first hull.

18 Claims, 5 Drawing Sheets

(58) Field of Classification Search
CPC ..... B63B 1/10; B63B 1/121; B63B 1/107; B63B 39/005; B63B 2003/085; B63B 2001/044
See application file for complete search history.

(56) References Cited

U.S. PATENT DOCUMENTS

| | | | | |
|---|---|---|---|---|
| 5,592,894 | A * | 1/1997 | Johnson | B60F 3/0038 114/274 |
| 7,314,014 | B2 | 1/2008 | Heyring et al. | |
| 8,220,404 | B2 * | 7/2012 | Grenestedt | B63B 1/14 114/61.15 |
| 8,307,773 | B2 * | 11/2012 | Smith | B63B 29/12 114/71 |
| 9,073,605 | B2 * | 7/2015 | Hall | B63B 39/04 |
| 9,150,282 | B2 | 10/2015 | Heyring et al. | |

OTHER PUBLICATIONS

International Preliminary Report on Patentability for Application No. PCT/AU2018/051315 dated Nov. 20, 2019 (4 pages).

* cited by examiner

WATER CRAFT SUSPENSION ARRANGEMENT

TECHNICAL FIELD

The present invention relates to water craft and specifically relates to locating arrangements such as suspension linkages for locating a hull relative to the body of a water craft.

BACKGROUND

Vessels or water craft in which one or more hulls are able to move relative the body portion are known, such as in the applicant's U.S. Pat. No. 7,314,014 in which the body is suspended above at least four hulls and the applicant's U.S. Pat. No. 9,150,282 in which the body is suspended above at least two hulls. In such vessels the hulls need to be located relative to the body portion, typically in the lateral, longitudinal, roll and yaw directions relative to the body. In the applicant's U.S. Pat. No. 9,150,282 an arrangement of a front trailing arm and a rear trailing arm are used, with a drop link in the rear trailing arm to enable pitch motions of the hull relative to the body. In the applicant's U.S. Pat. No. 9,272,753 the front radius arm, for example a leading arm, provides the longitudinal constraint of the hull with a rear slider arrangement contributing to the lateral constraint of the hull while permitting heave and pitch motions of the hull relative to the body.

However in all of the above hull locating arrangements, the longitudinal constraint of the hull relative to the body is provided by the front suspension linkage.

U.S. Pat. No. 3,326,166 discloses a watercraft having a hull locating arrangement comprising a hinge at the rear and two pivoted links at the front. In this arrangement, the longitudinal constraint is provided by the hinges at the rear which only permit rotation of the hull relative to the body. The two pivoted links at the front do not provide a longitudinal nor vertical constraint between the hull and the body. Vertical displacement between the rear of the hull and the body is prevented in this arrangement as the rear hinge provides a vertical constraint. Therefore, a heave mode of the hull relative to the body is not permitted.

SUMMARY OF INVENTION

In this specification, the term 'radius arm' includes leading or trailing arms, that may be angled to both the horizontal and longitudinal planes and are mainly used to provide longitudinal location.

According to a first aspect of the invention there is provided a hull locating arrangement for a vessel having a body at least partially suspended above at least a first hull by at least one support, the hull locating arrangement including for the first hull: a forward locating linkage and a rearward locating linkage (for example longitudinally spaced from the forward locating linkage), each connected between the first hull and the body to together constrain said hull in the lateral, longitudinal, roll and yaw directions relative to the body; the forward locating linkage including a forward radius arm and a drop link, the drop link being pivotally connected to the radius arm, the forward linkage being connected between the body and the first hull; the rearward locating linkage including a rearward radius arm connected between the body and the first hull. This permits motions of the first hull relative to the body in the heave mode and in the pitch mode independently. For example a pure heave mode motion is possible, as is a pure pitch mode motion and any combination of heave and pitch motions simultaneously.

A first end of the forward radius arm may be pivotally connected to either the body or the first hull by a first pivot, a first end of the drop link may be pivotally connected to the other of either the body or the first hull by a second pivot and a second end of the forward radius arm may be connected to a second end of the drop link by a third or intermediate pivot.

The first end of the forward radius arm may be pivotally connected to the first hull, so for example the first pivot may be a hull pivot. The first end of the drop link may be pivotally connected to the body, so for example the second pivot may be a body pivot. In this case, the body pivot may be above the (third or) intermediate pivot and the drop link may be housed in a tower, cupboard or recess in the body.

Alternatively, the first end of the forward radius arm may be pivotally connected to the body, so for example the first pivot may be a body pivot. The first end of the drop link may be pivotally connected to the first hull, so for example, the second pivot may be a hull pivot.

The (third or) intermediate pivot may be above or higher than the (second or) hull pivot, so for example the drop link may be connected from the second end of the forward radius arm, down to the hull when the vessel is in an operating position such as as at a ride height or at a position where the hull locating arrangement is at fifty percent of a total travel. Alternatively, the hull pivot may be above (or higher than) the (third or) intermediate pivot, so for example the drop link may be connected from the (second or) hull pivot on an up-stand or other feature on the hull, down to the (third or) intermediate pivot on the second end of the forward radius arm.

The at least a first hull may include a first hull and a second hull, for example a left hull and a right hull, the hull locating arrangement further including for the second hull a second forward locating linkage and a second rearward locating linkage, that is for example longitudinally spaced from the second forward locating linkage, each connected between the second hull and the body to together constrain said hull in the lateral, longitudinal, roll and yaw directions relative to the body. The second forward locating linkage may include a respective forward radius arm and drop link, the second drop link being pivotally connected to the second forward radius arm, the second forward linkage being connected between the body and the second hull. Similarly, the second rearward locating linkage may include a second rearward radius arm connected between the body and the second hull.

The body may be fully supported above the first and second hulls, i.e. the vessel may be a catamaran. Alternatively, the body may, in use, contact (or a portion of the body may, in use, engage) a surface of a body of water with which the first and second hulls are engaged. In a further alternative, the at least a first hull may further include a third and a fourth hull, the hull locating arrangement further including for the third hull and for the fourth hull respective forward and rearward locating linkages.

The at least one support may include at least one support between the body and the first hull.

Alternatively or additionally, the at least one support may include at least one first forward support between body and the forward locating linkage of the first hull. The first forward support may be connected between the body and the forward radius arm. Alternatively, in the forward locating linkage of the first hull, when the forward radius arm is pivotally connected to the body and the drop link is pivotally connected to the first hull, the at least one first forward support may be connected between the body and the drop link. As a further alternative in the forward locating linkage of the first hull, when the forward radius arm is pivotally connected to the body by a first pivot, the drop link is pivotally connected to the first hull by a second pivot and the drop link is pivotally connected to the radius arm by a (third or) intermediate pivot, the first forward support may be connected between the body and the (third or) intermediate pivot.

Alternatively, or additionally the at least one support may include at least one first rearward support between body and the rearward locating linkage of the first hull.

The configuration of a forward locating linkage and associated forward support may be arranged such that at least one support, or at least one of the at least one supports has a motion ratio that reduces displacement of the support relative to displacement between the hull and the body. Such an arrangement provides a mechanical advantage whereby a reduction in displacement of the support provides a related increase in loads in or on the supports.

Similarly, the configuration of a rearward locating linkage and associated rearward support may be arranged such that at least one support, or at least one of the at least one supports has a motion ratio that reduces displacement of the support relative to displacement between the hull and the body. Such an arrangement provides a mechanical advantage whereby greater reductions in displacement of the support provide correspondingly larger increase in loads in or on the supports.

Each respective pivot may have a respective pivot axis, each pivot axis may be substantially laterally aligned. Alternatively or additionally, each respective pivot may include at least one bearing, spherical joint or bushing, such as a stiff bushing or a resilient bushing.

It will be convenient to further describe the invention by reference to the accompanying drawings which illustrate preferred aspects of the invention. Other embodiments of the invention are possible and consequently particularity of the accompanying drawings is not to be understood as superseding the generality of the preceding description of the invention.

DESCRIPTION OF PREFERRED EMBODIMENT

Figure 1:
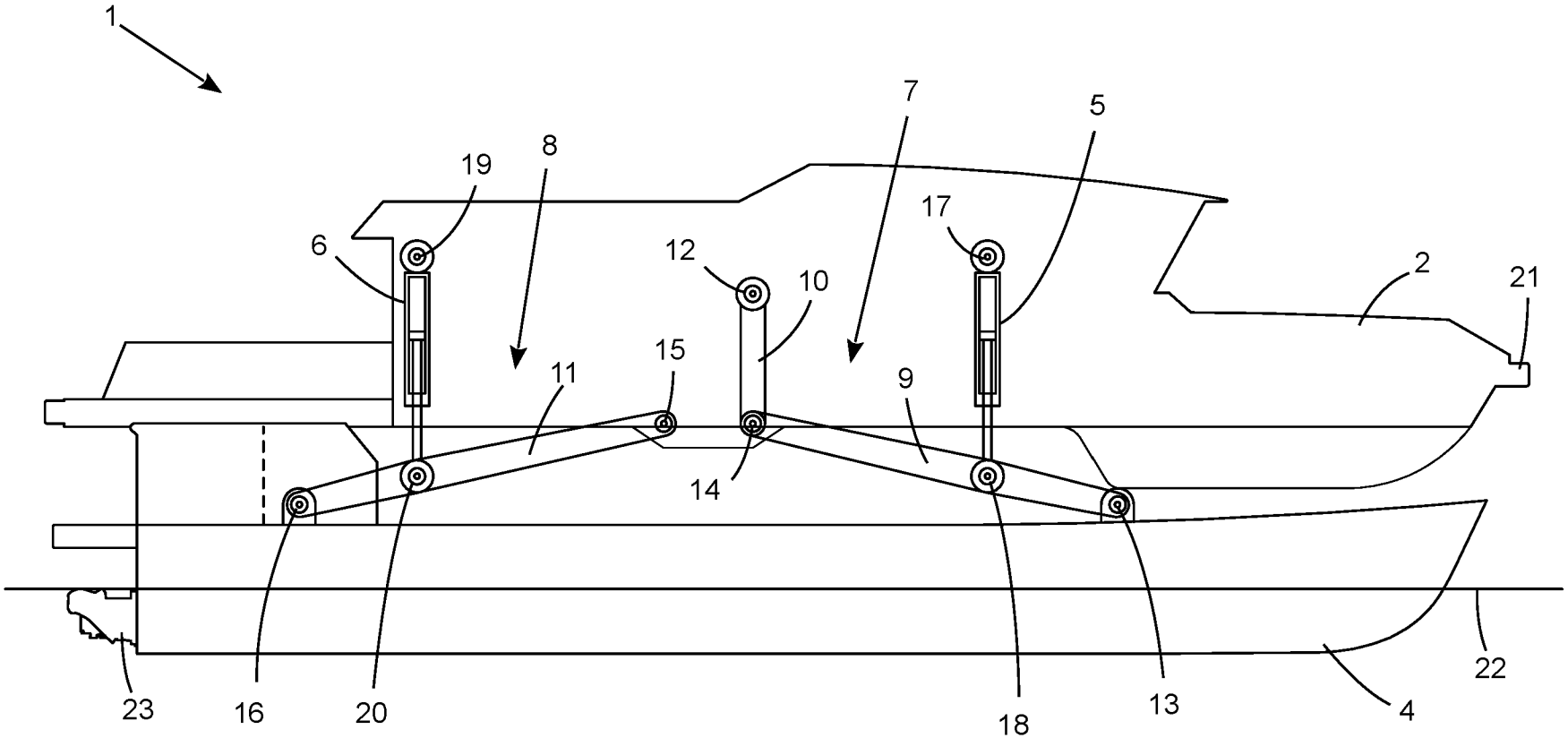
FIG. 1 is a side view of a vessel incorporating a hull locating arrangement according to the present invention.

Referring initially to FIG. 1, there is shown a water craft or vessel 1 having a body portion or body 2, suspended or supported above the hull 4 by supports including a front support 5 and a back support 6. The front and back supports are illustrated as rams although mechanical springs can be used. However, the advantages of using fluid filled devices such as air springs or hydraulic rams are many including adjustability for height and attitude, interconnectivity for modal support (i.e. providing different stiffness in different suspension modes such as pitch and heave) and modal damping control using valves in the fluid systems of the supports, or independent damping using separate fluid or electromagnetic dampers or actuators. The rearward locating linkage 8 includes a trailing arm 11 pivoted to the body at pivot or body mount 15 and pivoted to the hull at pivot or hull mount 16. This rearward locating linkage 8 provides longitudinal, lateral, roll and yaw constraints on the hull 4 relative to the body 2. The forward locating linkage 7 is connected between the body mount 12 and the hull mount 13 and includes a leading arm 9 and a drop link 10. The drop link 10 is pivoted to the body at the pivot or body mount 12 and is pivoted to the leading arm 9 by knee pivot or intermediate mount 14. The other end of the leading arm is pivoted to the hull at the pivot or hull mount 13. This forward locating linkage 7 provides additional lateral, roll and yaw constraints on the hull 4 relative to the body 2, but no longitudinal constraint, so the hull 4 is able to heave and pitch relative the body 2.

In FIG. 1, the front support 5 is shown as a hydraulic ram and is connected between the body 2 and the forward radius arm 9 by a front support top mount 17 to the body and a front support lower mount 18 to the forward radius arm. This arrangement provides a motion ratio for the front support, i.e. if the support is substantially vertical, then the further the front support mount lower mount 18 is positioned towards the knee pivot or intermediate mount 14, the lower the compression or extension displacement of the ram is for a given vertical displacement (upwards or downwards relative to the body) of the hull 4 and the larger the mechanical advantage and forces on the front support 5. Similarly the back support in FIG. 1 is shown as a hydraulic ram and is connected between the body 2 and the rearward radius arm 11 by a back support top mount 19 to the body and a back support lower mount 20 to the rearward radius arm. This arrangement provides a motion ratio for the back support which reduces the displacements and increases the mechanical advantage and the loads on the back support as the position of the back support lower mount 20 is moved along the rearward radius arm 11 towards the body mount 15 of the arm.

There are two main advantages to providing the longitudinal location of the hull (i.e. the longitudinal constraint between the body 2 and the hull 4) in the rearward locating linkage, both advantages being related to removing the correlation between vertical displacement of the front of the hull relative to the body and longitudinal hull shunt relative to the body. Firstly, the largest impact loads on the hull when under-way (i.e. during transit) are usually towards the front end. Also the front of the hull typically travels through a greater range of motion than the rear of the hull. So if for example the forward half of the hull loses contact with the water momentarily, the impact of the hull re-engaging with the water will frequently happen with the front leading arm in a downward position, which would transfer vertical and longitudinal force components (from the vertical impact of the hull into the water and from the longitudinal deceleration of the hull caused by increased engagement with the water) into the body 2 if the joint 14 at the rear end of the leading arm 9 was attached to the body. Indeed in such a case without a drop link, as the hull joint is constrained to move in an arc relative to the body, vertical motion of the hull joint requires relative longitudinal motion between the hull and the body, particularly when the leading arm is not horizontal. The use of the drop link 10 in the front locating linkage 7 decouples the hull mount from being constrained to move in an arc relative to the body so permits vertical inputs at the front of the hull to be absorbed by the front support 5 of the front suspension without requiring a longitudinal motion of the hull relative to the body when the leading arm is significantly away from horizontal, such as in a fully extended position of the front suspension. It also prevents the longitudinal component present at the front hull mount 13 from being transmitted directly into the body, thus improving comfort in transit.

Secondly, when in a transfer position with the buffer 21 on the bow of the vessel body 2 pushing into a pylon for example, if the front leading arm 9 pivoted to the hull 4 at pivot or hull mount 13 was pivoted at the opposite end to the body at 14 (i.e. without the drop link 10, so the front hull mount 13 would be restricted to a fixed arc of motion centred around the front body mount which would be located at 14), then as waves pass under the front of the hull 4, the vertical motion of the front of the hull could cause a change in load in the front support 5 and therefore a change in the vertical force between the buffer 21 and the pylon (not shown). If this vertical force between the buffer 21 and the pylon exceeds the maximum frictional force determined for example by buffer frictional characteristics and the thrust from the vessel propulsion system pushing the buffer into the pylon, then the buffer 21 at the front of the body 2 can slip relative to the pylon which provides a significant hazard for personnel attempting to transfer between the pylon and the vessel.

Wave action changing support loads and therefore the vertical force between the buffer and the pylon is known and providing modal stiffness or suspension control to reduce the force change is known. However if the front locating linkage 7 does not include the drop link 10, then the changes in the vertical position of the front hull mount 13 can also attempt to drag the body 2 forwards or backwards by distances that are dependent in part on the angle of the leading arm away from horizontal. As this action would be in phase with the motion of the leading arm 9 (which acts like a radius arm), when the front suspension locating linkage is at full extension for example, and a wave pushes the front of the hull upwards, the resultant upward motion of the hull mount 13 rotates the radius arm in a direction that attempts to simultaneously compress the support 5 (increasing the vertical force between the buffer 21) and push the body 2 backwards relative to the hull 4 (reducing the longitudinal thrust force of the body 2 onto the pylon).

This combination of increasing the vertical force and decreasing the longitudinal thrust force can cause the buffer 21 at the bow of the vessel to slip on the pylon. This is because the vertical force is attempting to break the maximum frictional force between the buffer and the pylon and because that maximum frictional force is dependent on the longitudinal thrust force. However if the drop link 10 is provided in the front locating linkage 7, decoupling the vertical motion of the front hull mount 13 from a longitudinal motion of the body 2 relative to the hull 4, then for the same wave input, the risk of the buffer slipping on the pylon is reduced.

In the arrangement in FIG. 1, the rear locating linkage 8 provides the longitudinal constraint between the body 2 and the hull 4 by trailing arm 11 which can act like a radius arm, but moving the longitudinal constraint between the hull and the body to the rear has two advantages. Firstly, the phase of the motion of the rear hull mount 16 is different to the phase of the motion of the front hull mount 13 and the front support 5, so the timing of a longitudinal force caused by an increase in water resistance due to the front of the hull impacting a wave but reacted by the rear trailing arm 11 is separated from the timing of the vertical force caused by that wave when it reaches the rear of the hull. Secondly, the magnitude of motion of the rear of the hull 4 relative to the body 2 is typically less than the magnitude of motion of the front of the hull relative to the body, so the maximum angle of the rear trailing arm relative to horizontal can be less than the maximum angle of the front leading arm from horizontal, which in turn can limit the longitudinal displacements and accelerations required between the hull and the body through the full range of travel of the rear suspension.

In FIG. 1 the static water-line 22 is shown relative to the hull 4 and the propulsion device 23 is shown as a water jet type device although many known forms of propulsion can be used. In the following Figures like reference numerals are used for similar or equivalent features or components.

Figure 2:
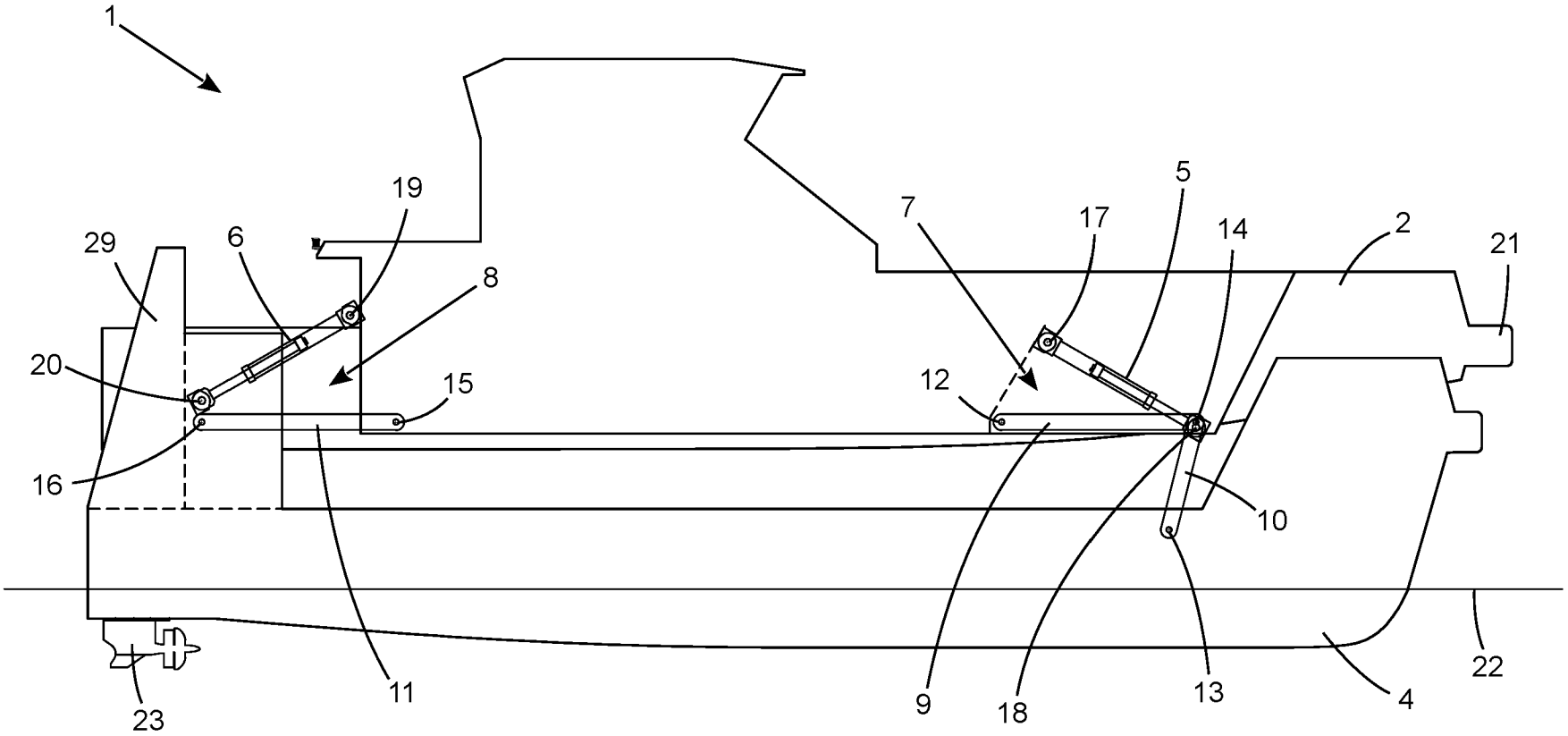
FIG. 2 is a side view of a vessel incorporating another hull locating arrangement according to the present invention, with the suspension at mid stroke position.
Figure 3:
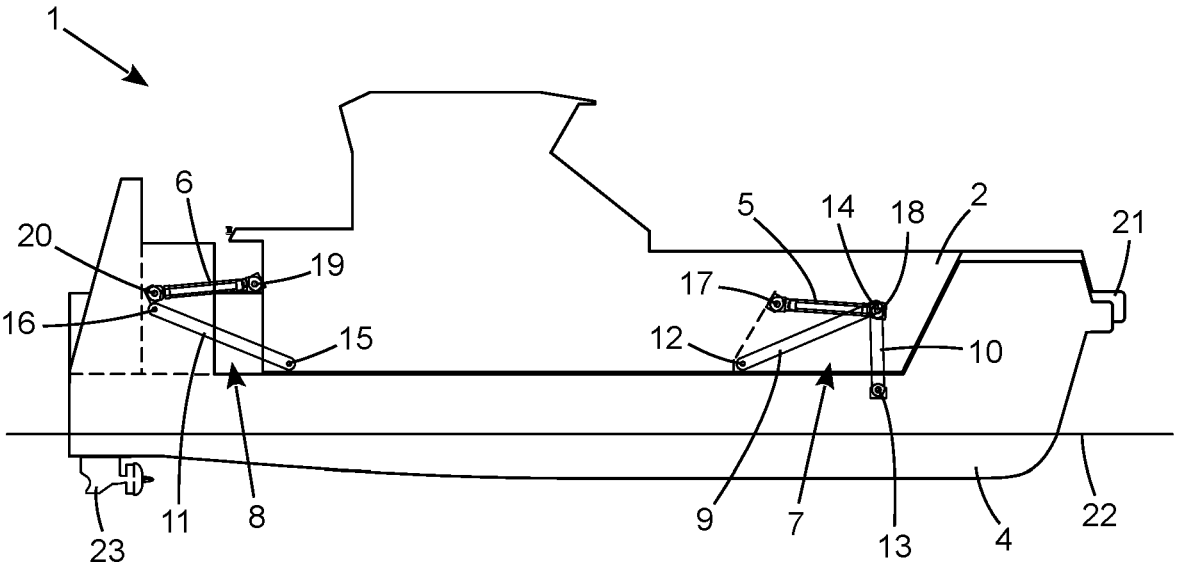
FIG. 3 is a side view of the vessel of FIG. 2 with the suspension in a fully compressed position.
Figure 4:
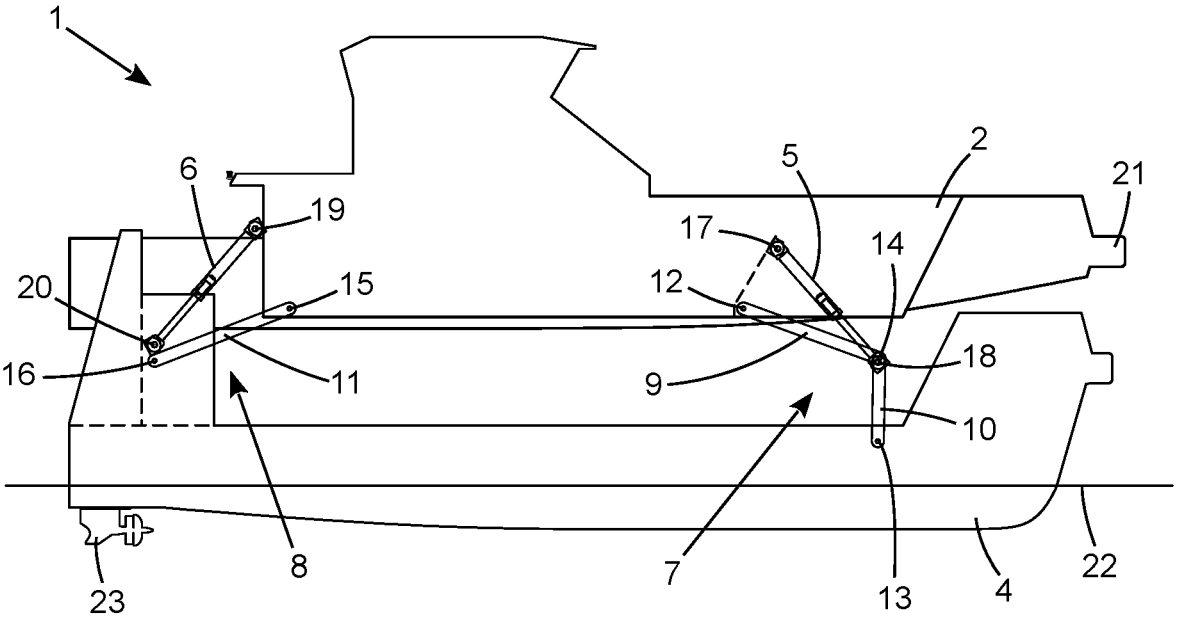
FIG. 4 is a side view of the vessel of FIG. 2 with the suspension in a fully extended position.

FIG. 2 shows a similar to vessel 1 to FIG. 1, but having two main differences: firstly, in the forward locating linkage 7, the drop link 10 is now between the forward radius arm 9 and the hull 4; and secondly, the front and back supports 5 & 6 are not only now oriented in inclined positions to again provide a motion ratio, but also in the forward locating linkage 7 the front support 5 is connected between the body 2 and either the end of the forward radius arm 9 or the top of the drop link 10, and in the rearward locating linkage 8 the back support 6 is connected between the body and either an end of the rearward radius arm 11 or direct to the hull 4. As with FIG. 1, the vessel 1 in FIG. 2 is shown at an operating position such as one of a possible number of ride heights. FIG. 3 shows the same vessel 1 as in FIG. 2, but with the suspension fully compressed. FIG. 4 shows the same vessel 1 as in FIG. 2, but with the suspension fully extended.

In FIG. 2, at ride height the forward radius arm 9 (between the front pivot or body mount 12 and the knee joint or intermediate mount 14) is substantially horizontal. The drop link 10 is pivotally connected to the forward radius arm 9 at the intermediate mount 14 and pivotally connected to the hull 4 at the front pivot or hull mount 13. The drop link 10 is shown leaning slightly forward so that as the suspension extends and contracts as shown in FIGS. 3 and 4, the drop link passes through vertical. The lower ends of the drop link 10 towards the front hull mount 13 are shown passing into or around the hull. In practice the hull 4 can include two recesses, one either side, to receive the lower ends of the drop link 10. The recesses and the lower ends of the drop links can be hidden and the side of the hull made smooth by plates partially closing the outer end of each recess.

Figure 5:
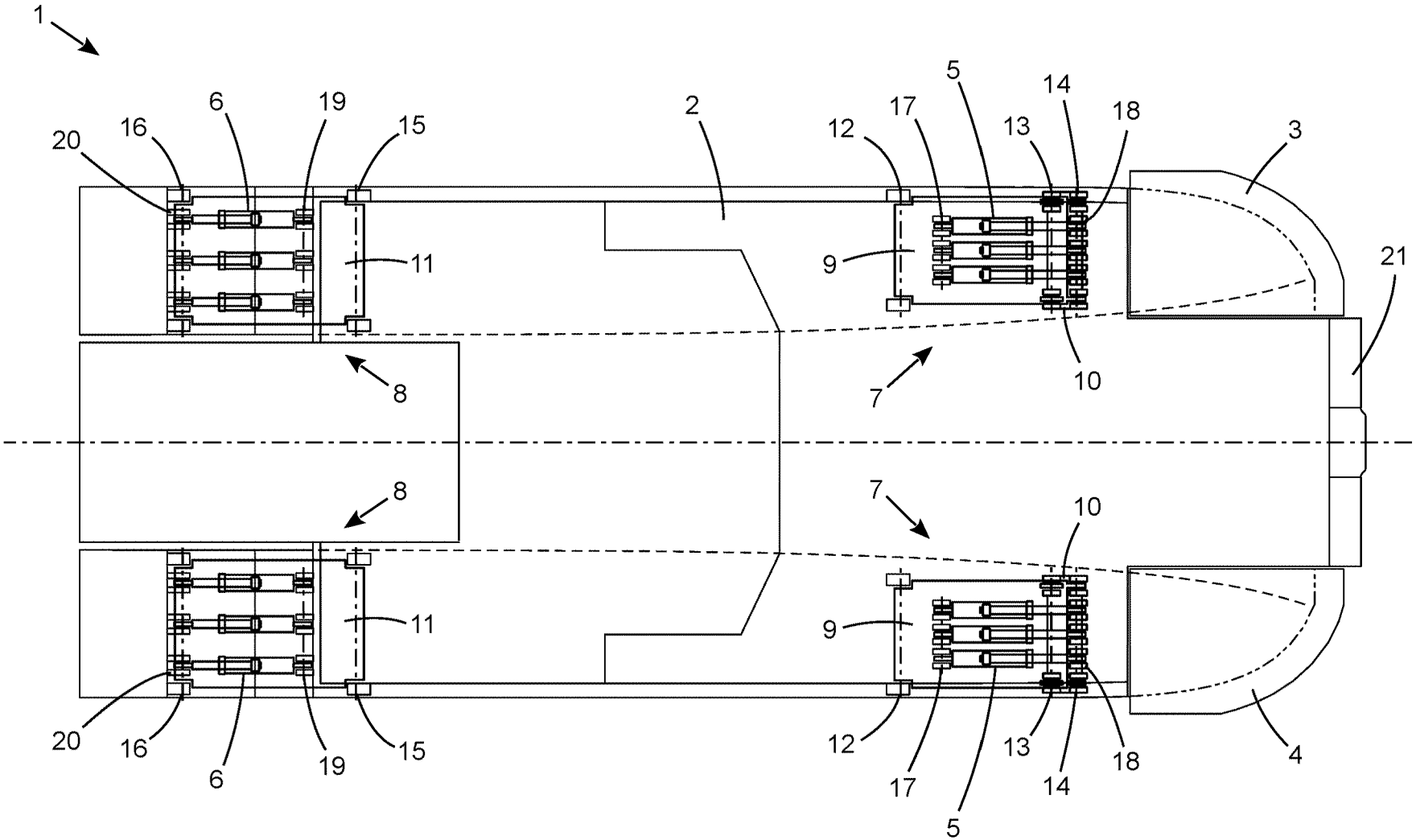
FIG. 5 is a plan view of the vessel of FIG. 2.

FIG. 5 shows a plan view of the vessel of FIG. 2 and in this view the front left and right supports 5 and rear left and right supports 6 are each shown as three hydraulic rams which can for example comprise: a pitch ram interconnected to other rams to provide pitch stiffness; a roll ram interconnected to other rams to provide roll stiffness; and a heave ram to provide support of the vessel. Alternatively, two of the rams can together provide roll, pitch and heave stiffness without providing a warp stiffness, using an arrangement such as shown in the Applicant's U.S. Pat. No. 9,150,282 or 9,061,735, with the third ram of each support providing damping and/or travel limits. As further alternatives, the supports can comprise any number of rams and some or all of the rams can be independent (i.e. not interconnected to other rams) and passive or controlled. As noted in relation to FIG. 1, the supports can comprise devices other than hydraulic rams, such as electro-magnetic actuators, air springs or mechanical springs and if one of the devices is a limit stop, it could if passive comprise a piston and resilient blocks or even be a strap to limit travel. If the limit stop is controlled the device is more likely to be a hydraulic ram type device.

The front support lower mounts 18 can have a pivot axis offset from the pivot axis of the knee joint or intermediate mount 14. If the intermediate mount 14 comprises two aligned pivots either side of the front support lower mounts 18 as shown in FIG. 5, then a significant offset can aid assembly and servicing. The front support lower mounts 18 can be connected to either the forward radius arm 18 or the drop link 10.

Similarly, the pivot axis of the back support lower mounts 20 can be aligned with or offset from the pivot axis of the rear hull mount 16. In the example shown in FIG. 2, the pivot axis of the back support lower mounts 20 is offset sufficiently from the pivot axis of the rear hull mount 16 to enable access to the pivots of both mounts for assembly and maintenance. Both mounts 16 and 20 are fixed to a structure 29 above the rear of the main body of the hull 4, that structure also optionally providing access and ventilation to the hull in the region of the engine and gearbox of the propulsion device 23.

The forward and rearward radius arms 9 and 11 are shown as substantially rectangular structures in FIG. 5 with the front or back body mounts 12 or 15 and the intermediate mounts 14 or hull mounts 16 at the corners. FIG. 2 shows that these rectangular structure have depth or thickness in side view. However the forward and rearward radius arms can be formed from cross-braced frames or combinations of box sections or other shell structures.

The embodiment of FIGS. 2 to 5 has the same core functionality of the embodiment of FIG. 1. That is, the forward and rearward locating linkages 7 and 8 of each hull work together such that roll and yaw rotations and lateral and longitudinal displacements of each hull are constrained relative to the body, but pitch rotations and heave displacements are permitted up to the limits of travel. When considering the motion of both hulls 3 and 4 together, heave in opposite directions of the left and right hulls relative to the body is a roll mode of the suspension system of the vessel, and pitch in opposite directions of the left and right hulls relative to the body is a warp mode of the suspension system of the vessel. The rearward locating linkage 8 again provides the longitudinal location of the respective hull. The drop link 10 in the forward locating linkage 7 ensures that longitudinal shunt motions of the hull relative to the body are not resolved by the forward locating linkage. As with the embodiment of FIG. 1, this can improve both comfort during transit and more importantly safety during transfer.

The arrangement of the forward locating linkage 7 of FIG. 2 requires less packaging height compared to the arrangement of FIG. 1, but to gain a suitable length of drop link 10 without having an excessive gap between the body and the hull, the recesses in the sides of the hull can be required.

Figure 6:
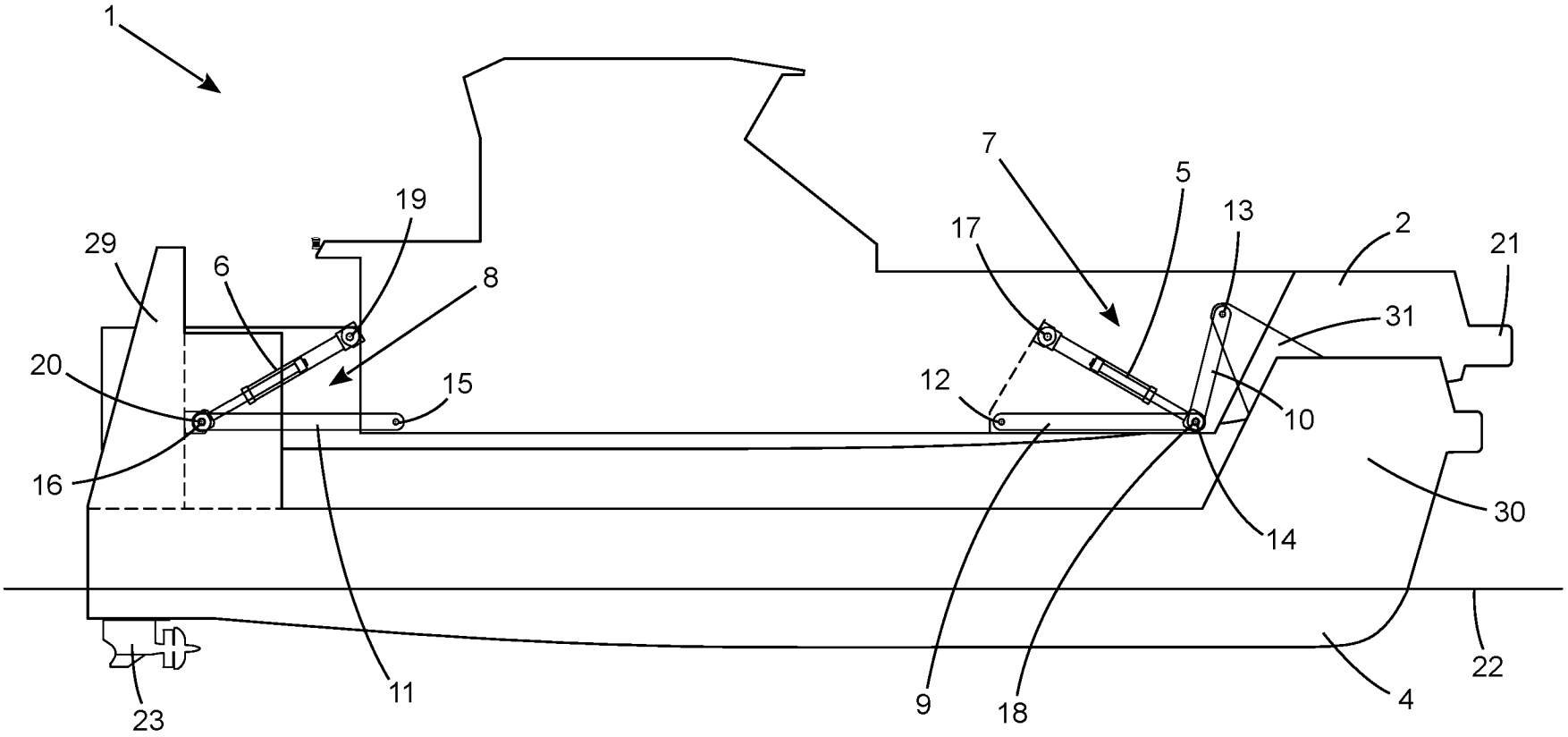
FIG. 6 is a side view of a vessel incorporating another hull locating arrangement according to the present invention.

FIG. 6 shows variations to the embodiment of FIG. 2. Firstly, the pivot axis of the back support lower mount 20 of the back support 6 is aligned with the rear hull mount 16 allowing a single pin to be driven through all of the bearings of the two mounts. Secondly and more importantly, the drop link 10 extends upwards from the knee joint or intermediate mount 14 at the end of the forward radius arm 9 up to the front hull mount 13. Such an arrangement is suited to hull designs having a tall profile 30 at the bow end of the hull. Even then an additional structure 31 may be required to provide the front hull mount 13 in the desired position and permit rotation of the drop link without interference with the hull.

The functionality of the arrangement in FIG. 6 is similar to the functionality of the arrangements in FIGS. 1 and 2.

It is envisaged that the supports 5 and 6 can comprise hydraulic rams and/or air springs and/or electro-magnetic actuators (which can be motor generators) and/or mechanical springs and/or any other known variable length supports. The supports can be interconnected to provide passive modal functionality, i.e. different stiffness in at least two of the four suspension modes of roll, pitch, heave and warp. The supports can be connected between the body and the locating linkages or alternatively at least one of the supports can be connected between the body and the hull. For example the limit stop supports can be connected directly between body and hull whereas the resilient or modal supports which may be subject to lower peak loads than the limit stop supports, may be connected between the body and the locating linkage or even between the hull and the locating linkage.

It is anticipated that the hull locating arrangements provided by the forward and rearward locating linkages 7 and 8 can be applied to any vessel having hulls movable relative to the body. For example, the body 2 may include a fixed hull portion engaging the water, which if used together with a left hull and a right hull would be a trimaran. The vessel may alternatively be a fully supported trimaran where the body is supported entirely above three hulls such as a left hull, a right hull and a third hull in the centre or offset forwards or rearwards from the left and right hulls. The forward and rearward locating linkages may alternatively be applied to at least one of, preferably all four of the hulls of a quadrimaran, the four hulls being arranged typically in a diamond or rectangular arrangement in plan view.

Each pivot axis is preferably laterally aligned. Each mount can include at least one bearing or bushing. Alternatively, to avoid tolerance complications with laterally aligned axes of multiple pivots, one or more of the mounts can include spherical bearings instead of bushings.

Modifications and variations as would be apparent to a skilled addressee are deemed to be within the scope of the present invention.

What is claimed is:

1. A hull locating arrangement for a vessel having a body at least partially suspended above at least a first hull by at least one support, the hull locating arrangement including for the first hull a forward locating linkage and a rearward locating linkage, each of the forward locating linkage and the rearward locating linkage being connected between the first hull and the body to together constrain said hull in the lateral, longitudinal, roll and yaw directions relative to the body, the forward locating linkage including a forward radius arm and a drop link, the drop link being pivotally connected to the radius arm, a first end of the forward radius arm being pivotally connected to either the body or the first hull by a first pivot, a first end of the drop link being pivotally connected to the other of either the body or the first hull by a second pivot and a second end of the forward radius arm being connected to a second end of the drop link by an intermediate pivot, the rearward locating linkage including a rearward radius arm connected between the body and the first hull.

2. A hull locating arrangement according to claim 1 wherein the first end of the forward radius arm is pivotally connected to the first hull and the first pivot is a hull pivot, and the first end of the drop link is pivotally connected to the body and the second pivot is a body pivot.

3. A hull locating arrangement according to claim 2 wherein the body pivot is above the intermediate pivot.

4. A hull locating arrangement according to claim 1 wherein the first end of the forward radius arm is pivotally connected to the body and the first pivot is a body pivot, and the first end of the drop link is pivotally connected to the first hull and the second pivot is a hull pivot.

5. A hull locating arrangement according to claim 4 wherein the intermediate pivot is above the hull pivot.

6. A hull locating arrangement according to claim 4 wherein the hull pivot is above the intermediate pivot.

7. A hull locating arrangement according to claim 1 wherein each respective pivot:

has a respective pivot axis, each pivot axis being substantially laterally aligned; and/or includes at least one bearing, spherical joint or bushing.

8. A hull locating arrangement according to claim 1, wherein the vessel comprises the first hull and a second hull, the hull locating arrangement further including for the second hull a second forward locating linkage and a second rearward locating linkage, each of the second forward locating linkage and second rearward locating linkage being connected between the second hull and the body to together constrain said hull in the lateral, longitudinal, roll and yaw directions relative to the body, the second forward locating linkage including a forward radius arm and a drop link, the drop link being pivotally connected to the radius arm, the second rearward locating linkage including a rearward radius arm connected between the body and the second hull.

9. A hull locating arrangement according to claim 8 wherein the body is fully supported above the first and second hulls.

10. A hull locating arrangement according to claim 8 wherein in use the body contacts a surface of a body of water with which the first and second hulls are engaged.

11. A hull locating arrangement according to claim 8 comprising a third and a fourth hull, the hull locating arrangement further including for the third hull and for the fourth hull respective forward and rearward locating linkages.

12. A hull locating arrangement for a vessel according to claim 1 wherein the at least one support includes at least one support between the body and the first hull.

13. A hull locating arrangement for a vessel according to claim 1 wherein the at least one support includes at least one first forward support between body and the forward locating linkage of the first hull.

14. A hull locating arrangement according to claim 13 wherein the first forward support is connected between the body and the forward radius arm.

15. A hull locating arrangement according to claim 13 wherein in the forward locating linkage of the first hull, the forward radius arm is pivotally connected to the body, the drop link is pivotally connected to the first hull and the at least one first forward support is connected between the body and the drop link.

16. A hull locating arrangement according to claim 13 wherein in the forward locating linkage of the first hull, the forward radius arm is pivotally connected to the body by a first pivot, the drop link is pivotally connected to the first hull by a second pivot and the drop link is pivotally connected to the radius arm by an intermediate pivot, the first forward support being connected between the body and the intermediate pivot.

17. A hull locating arrangement according to claim 16 wherein each respective pivot:

has a respective pivot axis, each pivot axis being substantially laterally aligned; and/or includes at least one bearing, spherical joint or bushing.

18. A hull locating arrangement according to claim 13 wherein the at least one support further includes at least one first rearward support between body and the rearward locating linkage of the first hull.

* * * * *